US008944072B2

(12) United States Patent
Chen et al.

(10) Patent No.: US 8,944,072 B2
(45) **Date of Patent: *Feb. 3, 2015**

(54) THERMAL TREATMENT PROCESS FOR TOBACCO MATERIALS

(75) Inventors: Gong Chen, Winston-Salem, NC (US); Anthony Richard Gerardi, Winston-Salem, NC (US); John-Paul Mua, Advance, NC (US); Darrell Eugene Holton, Jr., Clemmons, NC (US); Daniel Verdin Cantrell, Lewisville, NC (US); Frank Kelley St. Charles, Bowling Green, KY (US); Serban C. Moldoveanu, Winston-Salem, NC (US); Paul Andrew Brinkley, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 586 days.

This patent is subject to a terminal disclaimer.

(21) Appl. No.: 12/855,343

(22) Filed: Aug. 12, 2010

(65) Prior Publication Data

US 2011/0048434 A1 Mar. 3, 2011

Related U.S. Application Data

(63) Continuation-in-part of application No. 12/476,621, filed on Jun. 2, 2009, now Pat. No. 8,434,496.

(51) Int. Cl.

| | |
|---|---|
| ***A24B 3/18*** | (2006.01) |
| ***A24C 5/00*** | (2006.01) |
| ***A24D 3/00*** | (2006.01) |
| ***A24B 15/20*** | (2006.01) |
| ***A24B 3/12*** | (2006.01) |
| ***A24B 15/30*** | (2006.01) |

(52) U.S. Cl.

CPC . *A24B 15/20* (2013.01); *A24B 3/12* (2013.01); *A24B 15/30* (2013.01); *A24B 15/306* (2013.01); *A24B 15/307* (2013.01)

USPC ..... 131/280; 131/360; 131/331

(58) Field of Classification Search

CPC ..... A24B 15/20; A24B 15/30; A24B 15/306; A24B 15/307; A24B 15/12; A24B 15/24; A24B 15/302; A24B 13/00; A24B 3/12; A23G 3/48

USPC ..... 131/280

See application file for complete search history.

(56) References Cited

U.S. PATENT DOCUMENTS

| | | | | |
|---|---|---|---|---|
| 787,611 | A | 4/1905 | Daniels | |
| 1,086,306 | A | 2/1914 | Oelenheinz | |
| 1,376,586 | A | 5/1921 | Schwartz | |
| 1,437,095 | A | 11/1922 | Delling | |
| 1,757,477 | A | 7/1928 | Rosenhoch | |
| 2,122,421 | A | 7/1938 | Hawkinson | |
| 2,148,147 | A | 2/1939 | Baier | |
| 2,170,107 | A | 8/1939 | Baier | |
| 2,274,649 | A | 3/1942 | Baier | |
| 2,769,734 | A | 11/1956 | Bandel | |
| 2,770,239 | A | 11/1956 | Prats et al. | |
| 3,353,541 | A | 11/1967 | Hind et al. | |
| 3,398,754 | A | 8/1968 | Tughan | |
| 3,424,171 | A | 1/1969 | Rooker | |
| 3,476,118 | A | 11/1969 | Luttich | |
| 3,483,874 | A | 12/1969 | Hind | |
| 3,499,454 | A | 3/1970 | Hind | |
| 3,612,065 | A | 10/1971 | Rosen | |
| 3,760,815 | A | 9/1973 | Deszyck | |
| 3,847,164 | A | 11/1974 | Mattina et al. | |
| 3,851,653 | A | 12/1974 | Rosen | |
| 3,889,689 | A | 6/1975 | Rosen | |
| 3,943,942 | A * | 3/1976 | Anderson et al. | 131/359 |
| 4,131,117 | A | 12/1978 | Kite et al. | |
| 4,143,666 | A | 3/1979 | Rainer et al. | |

(Continued)

FOREIGN PATENT DOCUMENTS

| | | |
|---|---|---|
| WO | WO 2005/041699 | 5/2005 |
| WO | WO 2005/063060 | 7/2005 |
| WO | WO 2010/141278 A1 | 12/2010 |

OTHER PUBLICATIONS

"Ammonium Hydroxide" by Environmental Working Group. Headquarters: Washington, D.C. Copyright 2007-2013.*

(Continued)

*Primary Examiner* — Philip Tucker

*Assistant Examiner* — Vicki Wu

(74) *Attorney, Agent, or Firm* — Womble Carlyle Sandridge & Rice, LLP

(57) ABSTRACT

A method of preparing a tobacco material for use in a smoking article is provided, including (i) mixing a tobacco material, water, and an additive selected from the group consisting of lysine, glycine, histidine, alanine, methionine, glutamic acid, aspartic acid, proline, phenylalanine, valine, arginine, di- and trivalent cations, asparaginase, saccharides, phenolic compounds, reducing agents, compounds having a free thiol group, oxidizing agents, oxidation catalysts, plant extracts, and combinations thereof; (ii) heating the mixture; and (iii) incorporating the heat-treated mixture into a smoking article as a smokable material. A smoking article in the form of a cigarette is also provided that includes a tobacco material pre-treated to inhibit reaction of asparagine to form acrylamide in mainstream smoke. Upon smoking, the smoking article is characterized by an acrylamide content of mainstream smoke that is reduced relative to an untreated control smoking article.

22 Claims, No Drawings

(56) References Cited

U.S. PATENT DOCUMENTS

| | | | | |
|---|---|---|---|---|
| 4,150,677 | A | 4/1979 | Osborne, Jr. et al. | |
| 4,177,822 | A | 12/1979 | Bryant, Jr. et al. | |
| 4,194,514 | A | 3/1980 | Campbell | |
| 4,270,552 | A | 6/1981 | Jenkins et al. | |
| 4,306,577 | A | 12/1981 | Wu et al. | |
| 4,308,877 | A | 1/1982 | Mattina | |
| 4,341,228 | A | 7/1982 | Keritsis et al. | |
| 4,366,824 | A | 1/1983 | Rainer et al. | |
| 4,388,933 | A | 6/1983 | Rainer et al. | |
| 4,421,126 | A | 12/1983 | Gellatly | |
| 4,449,541 | A | 5/1984 | Mays et al. | |
| 4,513,756 | A | 4/1985 | Pittman et al. | |
| 4,528,993 | A | 7/1985 | Sensabaugh, Jr. et al. | |
| 4,537,204 | A | 8/1985 | Gaisch et al. | |
| 4,624,269 | A | 11/1986 | Story et al. | |
| 4,641,667 | A | 2/1987 | Schmekel et al. | |
| 4,674,519 | A | 6/1987 | Keritsis et al. | |
| 4,706,692 | A | 11/1987 | Gellatly | |
| 4,819,668 | A | 4/1989 | Shelar et al. | |
| 4,821,749 | A | 4/1989 | Toft et al. | |
| 4,836,224 | A | 6/1989 | Lawson et al. | |
| 4,941,484 | A | 7/1990 | Clapp et al. | |
| 4,962,774 | A | 10/1990 | Thomasson et al. | |
| 4,967,771 | A | 11/1990 | Fagg et al. | |
| 4,972,854 | A | 11/1990 | Kiernan et al. | |
| 4,986,286 | A | 1/1991 | Roberts et al. | |
| 4,987,906 | A * | 1/1991 | Young et al. | 131/297 |
| 4,987,907 | A | 1/1991 | Townend | |
| 5,005,593 | A | 4/1991 | Fagg | |
| 5,056,537 | A | 10/1991 | Brown et al. | |
| 5,065,775 | A * | 11/1991 | Fagg | 356/432 |
| 5,074,319 | A | 12/1991 | White et al. | |
| 5,092,352 | A | 3/1992 | Sprinkle, III et al. | |
| 5,099,862 | A | 3/1992 | White et al. | |
| 5,099,864 | A | 3/1992 | Young et al. | |
| 5,101,839 | A | 4/1992 | Jakob et al. | |
| 5,105,834 | A | 4/1992 | Saintsing et al. | |
| 5,131,414 | A | 7/1992 | Fagg et al. | |
| 5,131,415 | A | 7/1992 | Munoz et al. | |
| 5,143,097 | A | 9/1992 | Stephen Sohn et al. | |
| 5,148,819 | A | 9/1992 | Fagg | |
| 5,159,942 | A | 11/1992 | Brinkley et al. | |
| 5,203,354 | A | 4/1993 | Hickle | |
| 5,235,992 | A | 8/1993 | Sensabaugh, Jr. | |
| 5,318,050 | A | 6/1994 | Gonzalez-Parra et al. | |
| 5,325,877 | A | 7/1994 | Young et al. | |
| 5,327,917 | A | 7/1994 | Lekwauwa et al. | |
| 5,339,838 | A | 8/1994 | Young et al. | |
| 5,360,022 | A | 11/1994 | Newton et al. | |
| 5,387,416 | A | 2/1995 | White et al. | |
| 5,435,325 | A | 7/1995 | Clapp et al. | |
| 5,445,169 | A | 8/1995 | Brinkley et al. | |
| 5,501,237 | A | 3/1996 | Young et al. | |
| 5,533,530 | A | 7/1996 | Young et al. | |
| 5,724,998 | A | 3/1998 | Gellatly et al. | |
| 5,873,371 | A | 2/1999 | Giolvas | |
| 5,997,691 | A | 12/1999 | Gautam et al. | |
| 6,048,404 | A | 4/2000 | White | |
| 6,138,683 | A | 10/2000 | Hersh et al. | |
| 6,216,706 | B1 | 4/2001 | Kumar et al. | |
| 6,298,858 | B1 | 10/2001 | Coleman, III et al. | |
| 6,325,860 | B1 | 12/2001 | Coleman, III | |
| 6,415,798 | B1 | 7/2002 | Hersh et al. | |
| 6,428,624 | B1 | 8/2002 | Coleman, III et al. | |
| 6,440,223 | B1 | 8/2002 | Dube et al. | |
| 6,470,894 | B2 | 10/2002 | Hersh et al. | |
| 6,499,489 | B1 * | 12/2002 | Coleman, III | 131/309 |
| 6,591,841 | B1 | 7/2003 | White et al. | |
| 6,953,040 | B2 | 10/2005 | Atchley et al. | |
| 7,032,601 | B2 | 4/2006 | Atchley et al. | |
| 7,037,540 | B2 | 5/2006 | Elder et al. | |
| 7,267,834 | B2 | 9/2007 | Elder et al. | |
| 8,434,496 | B2 * | 5/2013 | Chen et al. | 131/309 |
| 2002/0162562 | A1 | 11/2002 | Williams | |
| 2002/0162563 | A1 | 11/2002 | Williams | |
| 2003/0119879 | A1 * | 6/2003 | Landh et al. | 514/343 |
| 2003/0200976 | A1 | 10/2003 | Yoo | |
| 2004/0020503 | A1 | 2/2004 | Williams | |
| 2004/0058046 | A1 | 3/2004 | Zyzak et al. | |
| 2004/0173228 | A1 | 9/2004 | Coleman, III | |
| 2005/0000526 | A1 | 1/2005 | Tarora et al. | |
| 2005/0178398 | A1 | 8/2005 | Breslin et al. | |
| 2005/0196504 | A1 | 9/2005 | Finley | |
| 2005/0244521 | A1 | 11/2005 | Strickland et al. | |
| 2006/0191548 | A1 | 8/2006 | Strickland et al. | |
| 2006/0194743 | A1 | 8/2006 | Oku et al. | |
| 2007/0062549 | A1 | 3/2007 | Holton, Jr. et al. | |
| 2007/0141225 | A1 * | 6/2007 | Elder et al. | 426/622 |
| 2007/0141227 | A1 | 6/2007 | Boudreaux et al. | |
| 2007/0166439 | A1 | 7/2007 | Soe et al. | |
| 2007/0186941 | A1 | 8/2007 | Holton, Jr. et al. | |
| 2007/0186942 | A1 | 8/2007 | Strickland et al. | |
| 2008/0029110 | A1 | 2/2008 | Dube et al. | |
| 2008/0029116 | A1 | 2/2008 | Robinson et al. | |
| 2008/0029117 | A1 | 2/2008 | Mua et al. | |
| 2008/0173317 | A1 | 7/2008 | Robinson et al. | |
| 2008/0196730 | A1 | 8/2008 | Engstrom et al. | |
| 2008/0209586 | A1 | 8/2008 | Nielsen et al. | |
| 2009/0032037 | A1 | 2/2009 | Xue et al. | |
| 2009/0047725 | A1 * | 2/2009 | Elder et al. | 435/229 |
| 2009/0304879 | A1 | 12/2009 | Zhang et al. | |
| 2010/0016202 | A1 * | 1/2010 | Mui et al. | 510/175 |
| 2010/0141278 | A1 | 6/2010 | Yamaguchi et al. | |

OTHER PUBLICATIONS

DSM Food Specialties, News: PreventASe Xtru: DSM's tailormade solution for acrylamide reduction in extruded snacks, Jul. 15, 2008.

National Cancer Institute: FactSheet, "Acrylamide in Food and Cancer Risk", Reviewed: Jul. 29, 2008.

Talhout et al., "Sugars as Tobacco Ingredient: Effects on Mainstream Smoke Composition", *Food and Chemical Toxicology*, 2006, pp. 1789-1798, vol. 44.

Vickery et al., "Glutamine and Asparagine in Tobacco Leaves", Biochemical Laboratory of the Connecticut Agricultural Experiment Station, New Haven, Nov. 7, 1935, pp. 157-160.

* cited by examiner

THERMAL TREATMENT PROCESS FOR TOBACCO MATERIALS

CROSS REFERENCE TO RELATED APPLICATIONS

This application is a continuation-in-part of U.S. application Ser. No. 12/476,621, filed Jun. 2, 2009 now U.S. Pat. No. 8,434,496, which is hereby incorporated herein in its entirety by reference.

FIELD OF THE INVENTION

The invention relates to processes for treatment of tobacco, and in particular, to processes useful for the thermal treatment of tobacco materials.

BACKGROUND OF THE INVENTION

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. A cigarette is employed by a smoker by lighting one end thereof and burning the tobacco rod. The smoker then receives mainstream smoke into his/her mouth by drawing on the opposite end (e.g., the filter end) of the cigarette.

The tobacco used for cigarette manufacture is typically used in blended form. For example, certain popular tobacco blends, commonly referred to as "American blends," comprise mixtures of flue-cured tobacco, burley tobacco and Oriental tobacco, and in many cases, certain processed tobaccos, such as reconstituted tobacco and processed tobacco stems. The precise amount of each type of tobacco within a tobacco blend used for the manufacture of a particular cigarette brand varies from brand to brand. However, for many tobacco blends, flue-cured tobacco makes up a relatively large proportion of the blend, while Oriental tobacco makes up a relatively small proportion of the blend. See, for example, *Tobacco Encyclopedia*, Voges (Ed.) p. 44-45 (1984), Browne, *The Design of Cigarettes*, 3rd Ed., p. 43 (1990) and *Tobacco Production, Chemistry and Technology*, Davis et al. (Eds.) p. 346 (1999).

Tobacco also may be enjoyed in a so-called "smokeless" form. Particularly popular smokeless tobacco products are employed by inserting some form of processed tobacco or tobacco-containing formulation into the mouth of the user. Various types of smokeless tobacco products are set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, III et al.; and U.S. Pat. No. 5,387,416 to White et al.; US Pat. Appl. Pub. Nos. 2005/0244521 to Strickland et al. and 2008/0196730 to Engstrom et al.; PCT WO 04/095959 to Arnarp et al.; PCT WO 05/063060 to Atchley et al.; PCT WO 05/016036 to Bjorkholm; and PCT WO 05/041699 to Quinter et al., each of which is incorporated herein by reference. See, for example, the types of smokeless tobacco formulations, ingredients, and processing methodologies set forth in U.S. Pat. No. 6,953,040 to Atchley et al. and U.S. Pat. No. 7,032,601 to Atchley et al., each of which is incorporated herein by reference.

One type of smokeless tobacco product is referred to as "snuff." Representative types of moist snuff products, commonly referred to as "snus," are manufactured in Europe, particularly in Sweden, by or through companies such as Swedish Match AB, Fiedler & Lundgren AB, Gustavus AB, Skandinavisk Tobakskompagni A/S, and Rocker Production AB. Snus products available in the U.S.A. are marketed under the tradenames Camel Snus Frost, Camel Snus Original and Camel Snus Spice by R. J. Reynolds Tobacco Company. Representative smokeless tobacco products also are marketed under the tradenames Oliver Twist by House of Oliver Twist A/S; Copenhagen, Skoal, SkoalDry, Rooster, Red Seal, Husky, and Revel by U.S. Smokeless Tobacco Co.; "taboka" by Philip Morris USA; and Levi Garrett, Peachy, Taylor's Pride, Kodiak, Hawken Wintergreen, Grizzly, Dental, Kentucky King, and Mammoth Cave by Conwood Sales Co., L.P. See also, for example, Bryzgalov et al., 1N1800 Life Cycle Assessment, Comparative Life Cycle Assessment of General Loose and Portion Snus (2005). In addition, certain quality standards associated with snus manufacture have been assembled as a so-called GothiaTek standard.

Through the years, various treatment methods and additives have been proposed for altering the overall character or nature of tobacco materials utilized in tobacco compositions. For example, additives or treatment processes are sometimes utilized in order to alter the chemistry or sensory properties of the tobacco material, or in the case of smokable tobacco materials, to alter the chemistry or sensory properties of mainstream smoke generated by smoking articles including the tobacco material. In some cases, a heat treatment process can be used to impart a desired color or visual character to the tobacco material, desired sensory properties to the tobacco material, or a desired physical nature or texture to the tobacco material.

In particular, the sensory attributes of cigarette smoke can be enhanced by incorporating flavoring materials into various components of a cigarette. See, Leffingwell et al., *Tobacco Flavoring for Smoking Products*, R.J. Reynolds Tobacco Company (1972). Exemplary flavoring additives include menthol and products of Maillard reactions, such as pyrazines, aminosugars, and Amadori compounds. Various processes for preparing flavorful and aromatic compositions for use in tobacco compositions are set forth in U.S. Pat. No. 3,424,171 to Rooker; U.S. Pat. No. 3,476,118 to Luttich; U.S. Pat. No. 4,150,677 to Osborne, Jr. et al.; U.S. Pat. No. 4,986,286 to Roberts et al.; U.S. Pat. No. 5,074,319 to White et al.; U.S. Pat. No. 5,099,862 to White et al.; U.S. Pat. No. 5,235,992 to Sensabaugh, Jr.; U.S. Pat. No. 6,298,858 to Coleman, III et al.; U.S. Pat. No. 6,325,860 to Coleman, III et al.; U.S. Pat. No. 6,428,624 to Coleman, III et al.; U.S. Pat. No. 6,440,223 to Dube et al.; U.S. Pat. No. 6,499,489 to Coleman, III; and U.S. Pat. No. 6,591,841 to White et al.; US Pat. Appl. Publication No. 2004/0173228 to Coleman, III; and U.S. application Ser. No. 12/191,751 to Coleman, III et al., filed Aug. 14, 2008, each of which is incorporated herein by reference. Such processes often include the application of heat to a tobacco material, which can result in reactions that form certain byproducts.

The sensory attributes of smokeless tobacco can also be enhanced by incorporation of certain flavoring materials. See, for example, US Pat. Appl. Pub. Nos. 2002/0162562 to Williams; 2002/0162563 to Willams; 2003/0070687 to Atchley et al.; 2004/0020503 to Williams, 2005/0178398 to Breslin et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; and 2008/0209586 to Neilsen et al., each of which is incorporated herein by reference.

It would be desirable in the art to provide further methods for altering the character and nature of tobacco (and tobacco compositions and formulations) useful in smoking articles or smokeless tobacco products.

SUMMARY OF THE INVENTION

The present invention provides a method of thermally processing a tobacco material in the presence of an additive adapted to alter the nature and character of the tobacco material, such as by changing the sensory properties of the tobacco material or changing the chemistry of the resulting heat-treated product. In particular, certain additives are used to inhibit the formation of reaction products resulting from the reaction of asparagine with certain reducing sugars. More specifically, certain embodiments of the invention provide tobacco products, including smoking articles and smokeless tobacco compositions, that include tobacco material pre-treated with an additive in order to inhibit reaction of asparagine to form acrylamide upon heating or burning of the tobacco material. Exemplary additives include amino acids, compositions incorporating di- and trivalent cations, asparaginase, certain non-reducing saccharides, certain reducing agents, phenolic compounds (e.g., compounds having at least one phenolic functionality), certain compounds having at least one free thiol group or functionality, oxidizing agents, oxidation catalysts, natural plant extracts (e.g., rosemary extract), and combinations thereof. The invention is also based in part on the recognition that certain heat treatment parameters can be controlled in order to change the chemistry of the resulting heat-treated product, such as maintaining the pH below about 8 during heating steps or reducing the heating time or temperature.

In one aspect, the invention provides a method of thermally processing a tobacco material for use in a smoking article or a smokeless tobacco composition, comprising: (i) mixing tobacco material with water and an additive capable of inhibiting reaction of asparagine to form acrylamide upon heating or burning of the tobacco material (e.g., an additive selected from the group consisting of lysine, glycine, histidine, alanine, methionine, glutamic acid, aspartic acid, proline, phenylalanine, valine, arginine, compositions incorporating di- and trivalent cations, asparaginase, certain non-reducing saccharides, certain reducing agents, phenolic compounds, certain compounds having at least one free thiol group or functionality, oxidizing agents, oxidation catalysts, natural plant extracts (e.g., rosemary extract), and combinations thereof), to form a moist tobacco mixture; (ii) heating the moist tobacco mixture at a temperature of at least about 60° C. (e.g., at least about 100° C.) to form a heat-treated tobacco mixture; and (iii) incorporating the heat-treated tobacco mixture into a tobacco product, such as a smoking article or a smokeless tobacco product For example, the heat-treated tobacco mixture could be used as a smokable material within a smoking article such as a cigarette.

Preferred additives include lysine, glycine, histidine, alanine, methionine, glutamic acid, aspartic acid, proline, phenylalanine, valine, arginine, cysteine, asparaginase, oxidizing agents (e.g., hydrogen peroxide or ozone), oxidation catalysts (e.g., titanium dioxide), and combinations thereof. The amount of the additive can vary, but is typically between about 100 ppm to about 10 dry weight percent. The heat-treated tobacco mixture often can include further components, such as flavorants, fillers, binders, pH adjusters, buffering agents, colorants, disintegration aids, antioxidants, humectants, and preservatives.

In another aspect, the invention provides a method of preparing a smokeless tobacco product, comprising: (i) mixing tobacco material; ingredients such as water, flavorant, binder, and filler; and an additive selected from the group consisting of lysine, glycine, histidine, alanine, methionine, glutamic acid, aspartic acid, proline, phenylalanine, valine, arginine, compositions incorporating di- and trivalent cations, asparaginase, certain non-reducing saccharides, certain reducing agents, phenolic compounds, certain compounds having at least one free thiol group or functionality, oxidizing agents, oxidation catalysts, natural plant extracts (e.g., rosemary extract), and combinations thereof, to form a moist tobacco mixture; (ii) forming the moist tobacco mixture into a desired product shape; and (iii) heating the moist tobacco mixture at a temperature of at least about 60° C. (e.g., at least about 100° C.) so as to provide a heat treatment process step and hence produce a dried smokeless tobacco product.

The heat treatment process can be characterized by the change in moisture content of the tobacco composition. For example, the moist tobacco mixture can have a moisture content of greater than about 20 weight percent, based on the total weight of the tobacco mixture; and the dried smokeless tobacco product can have a moisture content of less than about 10 weight percent. The heat treatment process can also be characterized by the pH during the heating step, which can be less than about 10.0, less than about 8.0, less than about 7.0, or less than about 6.5.

The desired product shape can have the form of a pill, tablet, sphere, sheet, coin, cube, bead, ovoid, obloid, bean, stick, or rod. Such product shapes can be formed in a variety of manners using equipment such as moving belts, nips, extruders, granulation devices, compaction devices, and the like. Alternatively, the treated tobacco material can be used in a particulate form.

In one embodiment, the method of the invention includes (i) mixing about 10 to about 60 dry weight percent of a tobacco material, up to about 50 dry weight percent of one or more fillers, about 10 to about 85 weight percent water, about 5 to about 30 dry weight percent of one or more binders, up to about 10 dry weight percent of one or more flavorants, and at least about 0.1 dry weight percent of an additive selected from the group consisting of lysine, glycine, histidine, alanine, methionine, glutamic acid, aspartic acid, proline, phenylalanine, valine, arginine, compositions incorporating di- and trivalent cations, asparaginase, certain non-reducing saccharides, certain reducing agents, phenolic compounds, certain compounds having at least one free thiol group or functionality, oxidizing agents, oxidation catalysts, natural plant extracts (e.g., rosemary extract), and combinations thereof, to form a moist tobacco mixture; (ii) forming the moist tobacco mixture into a desired product shape; and (iii) heating the moist tobacco mixture at a temperature of at least about 100° C. for a heat processing time (e.g., at least about 15 minutes) in order to produce a dried smokeless tobacco product having a moisture content of no more than about 10 weight percent.

In yet another aspect, the invention provides a heat-treated tobacco composition prepared according to the method of the invention. Such heat-treated compositions can be characterized by low acrylamide content, such as an acrylamide content of less than about 2000 ppb, less than about 1500 ppb, less than about 1000 ppb, less than about 900 ppb, less than about 800 ppb, less than about 700 ppb, less than about 600 ppb, less than about 500 ppb, less than about 400 ppb, or less than about 300 ppb.

In one embodiment, the invention provides a heat-treated smokeless tobacco composition comprising a tobacco material, water, a flavorant, a binder, and a filler, wherein the heat-treated smokeless tobacco composition has an acrylamide content of no more than about 1500 ppb. The heat-treated smokeless tobacco composition can have a preformed shape selected from the group consisting of pill, tablet, sphere, sheet, coin, cube, bead, ovoid, obloid, bean, stick, and rod. The moisture content of the heat-treated smokeless tobacco composition is typically no more than about 10 weight percent.

The amounts of each ingredient of the heat-treated smokeless tobacco composition can vary, but in one embodiment, the composition comprises about 20 to about 60 dry weight percent of a tobacco material, about 20 to about 50 dry weight percent of one or more fillers, about 5 to about 20 dry weight percent of one or more binders, and about 1 to about 10 dry weight percent of one or more flavorants.

In embodiments wherein the treated tobacco of the invention is utilized in smoking articles, the tobacco can be in the form of cut filler. The tobacco material can also be in blended form.

A smoking article containing the treated tobacco of the invention can be characterized, upon smoking, by an acrylamide content of mainstream smoke that is reduced relative to an untreated control smoking article. The amount of acrylamide reduction in mainstream smoke is typically at least about 10 percent as compared to an untreated control smoking article, meaning the amount by weight of acrylamide in mainstream smoke produced by a smoking article of the invention is at least about 10 percent less than the amount of acrylamide produced by an untreated control smoking article smoked under the same conditions (e.g., under ISO conditions). The amount of reduction is often at least about 30 percent, more often at least about 50 percent, and most often at least about 60 percent.

In one aspect, the invention provides a smoking article in the form of a cigarette comprising a rod of smokable material circumscribed by a wrapping material and a filter attached to the rod at one end thereof, wherein the smokable material comprises a tobacco material pre-treated to inhibit reaction of asparagine to form acrylamide in mainstream smoke. The pre-treatment can comprise the treatment process described herein, such as heating the tobacco material in the presence of an additive of the types discussed herein.

DETAILED DESCRIPTION OF THE INVENTION

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

The invention provides a heat-treated tobacco composition and a method for preparing a heat-treated tobacco composition. As used herein, the term "heat-treated tobacco composition" refers to a composition comprising a tobacco material that has been thermally processed at an elevated temperature, such as a temperature of at least about 60° C., more typically at least about 100° C., for a time sufficient to alter the character or nature of the tobacco composition, such as at least about 10 minutes. In some cases, the heat treatment process alters the chemistry or sensory characteristics (e.g., taste and aroma) of the tobacco composition. The heat treatment process of the invention can be a modified version of conventional tobacco treatment processes, such as processes adapted to form flavorful and aromatic compounds (e.g., Maillard reaction products), processes adapted for pasteurization of tobacco compositions, processes for preparing tobacco casing products, reconstituted tobacco processes (e.g., cast sheet and paper-making reconstituted tobacco processes), tobacco extraction processes, reordering processes, toasting processes, steam treatments, and drying processes.

The heat-treated tobacco compositions of the invention can be used as an additive for a smoking article (e.g., as part of the smokable blend or as an additive to the filter or wrapping paper of the smoking article) or as a smokeless tobacco composition, such as loose moist snuff, loose dry snuff, chewing tobacco, pelletized tobacco pieces, extruded or formed tobacco strips, pieces, rods, or sticks, finely divided ground powders, finely divided or milled agglomerates of powdered pieces and components, flake-like pieces, molded processed tobacco pieces, pieces of tobacco-containing gum, rolls of tape-like films, readily water-dissolvable or water-dispersible films or strips, or capsule-like materials.

Tobaccos used in the tobacco compositions of the invention may vary. The tobaccos may include types of tobaccos such as flue-cured tobacco, burley tobacco, sun-cured tobacco (e.g., Oriental tobacco or Indian Kurnool), Maryland tobacco, dark tobacco, dark-fired tobacco, dark air cured (e.g., passanda, cubano, jatin and bezuki tobaccos) or light air cured (e.g., North Wisconsin and galpoa tobaccos), and *Rustica* tobaccos, as well as other rare or specialty tobaccos or even green or uncured tobaccos. Descriptions of various types of tobaccos, growing practices, harvesting practices and curing practices are set forth in *Tobacco Production, Chemistry and Technology*, Davis et al. (Eds.) (1999), which is incorporated herein by reference. See, also, the types of tobaccos that are set forth in U.S. Pat. No. 4,660,577 to Sensabaugh, Jr. et al.; U.S. Pat. No. 5,387,416 to White et al.; and U.S. Pat. No. 6,730,832 to Dominguez et al., each of which is incorporated herein by reference. Most preferably, the tobacco materials are those that have been appropriately cured and aged. Especially preferred techniques and conditions for curing flue-cured tobacco are set forth in Nestor et al., Beitrage Tabakforsch. Int., 20 (2003) 467-475 and U.S. Pat. No. 6,895,974 to Peele, which are incorporated herein by reference. Representative techniques and conditions for air curing tobacco are set forth in Roton et al., Beitrage Tabakforsch. Int., 21 (2005) 305-320 and Staaf et al., Beitrage Tabakforsch. Int., 21 (2005) 321-330, which are incorporated herein by reference. Certain types of unusual or rare tobaccos can be sun cured. Manners and methods for improving the smoking quality of Oriental tobaccos are set forth in U.S. Pat. No. 7,025,066 to Lawson et al., which is incorporated herein by reference. Representative Oriental tobaccos include katerini, prelip, komotini, xanthi and yambol tobaccos. Tobacco compositions including dark air cured tobacco are set forth in US Patent Appl. Pub. No. 2008/0245377 to Marshall et al., which is incorporated herein by reference.

In one embodiment, the tobacco material, or at least some portion thereof, is selected so as to have a naturally low level of asparagine. A representative range of asparagine content in certain tobacco lamina typically can range from about 0.2 to about 0.7 dry weight percent. Certain representative stem tobacco materials typically contain lower levels of asparagine, such as about 0.1 to about 0.3 dry weight percent. Representative tobacco materials in blended forms used in smoking articles or smokeless tobacco products typically possess an asparagine content of about 0.1 to about 0.4 dry weight percent.

Tobacco compositions used in the present invention, such as tobacco compositions intended to be used in a smokeless form, may incorporate a single type of tobacco (e.g., in a so-called "straight grade" form). For example, the tobacco within a tobacco composition may be composed solely of flue-cured tobacco (e.g., all of the tobacco may be composed, or derived from, either flue-cured tobacco lamina or a mixture of flue-cured tobacco lamina and flue-cured tobacco stem). The tobacco within a tobacco composition also may have a so-called "blended" form. For example, the tobacco within a tobacco composition of the present invention may include a mixture of parts or pieces of flue-cured, burley (e.g., Malawi burley tobacco) and Oriental tobaccos (e.g., as tobacco composed of, or derived from, tobacco lamina, or a mixture of tobacco lamina and tobacco stem). For example, a representative blend may incorporate about 30 to about 70 parts burley tobacco (e.g., lamina, or lamina and stem), and about 30 to about 70 parts flue cured tobacco (e.g., stem, lamina, or lamina and stem) on a dry weight basis. Other exemplary tobacco blends incorporate about 75 parts flue-cured tobacco, about 15 parts burley tobacco, and about 10 parts Oriental tobacco; or about 65 parts flue-cured tobacco, about 25 parts burley tobacco, and about 10 parts Oriental tobacco; or about 65 parts flue-cured tobacco, about 10 parts burley tobacco, and about 25 parts Oriental tobacco; on a dry weight basis. Other exemplary tobacco blends incorporate about 20 to about 30 parts Oriental tobacco and about 70 to about 80 parts flue-cured tobacco.

The tobacco material can have the form of processed tobacco parts or pieces, cured and aged tobacco in essentially natural lamina or stem form, a tobacco extract, extracted tobacco pulp (e.g., using water as a solvent), or a mixture of the foregoing (e.g., a mixture that combines extracted tobacco pulp with granulated cured and aged natural tobacco lamina). In some embodiments, it is desirable to thoroughly wash the tobacco material in water in order to remove some of the asparagine within the tobacco.

The tobacco that is used for the tobacco product most preferably includes tobacco lamina, or tobacco lamina and stem mixture. Tobacco mixtures incorporating a predominant amount of tobacco lamina, relative to tobacco stem, are preferred. Most preferably, the tobacco lamina and stem are used in an unextracted form, that is, such that the extractable portion (e.g., the water soluble portion) is present within the unextractable portion (e.g., the tobacco pulp) in a manner comparable to that of natural tobacco provided in a cured and aged form. Portions of the tobaccos within the tobacco product may have processed forms, such as processed tobacco stems (e.g., cut-rolled stems, cut-rolled-expanded stems or cut-puffed stems), or volume expanded tobacco (e.g., puffed tobacco, such as dry ice expanded tobacco (DIET)). See, for example, the tobacco expansion processes set forth in U.S. Pat. No. 4,340,073 to de la Burde et al.; U.S. Pat. No. 5,259,403 to Guy et al.; and U.S. Pat. No. 5,908,032 to Poindexter, et al.; and US Patent Appl. Pub. No. 2004/0182404 to Poindexter, et al., all of which are incorporated by reference. In addition, the tobacco product optionally may incorporate tobacco that has been fermented. See, also, the types of tobacco processing techniques set forth in PCT WO 05/063060 to Atchley et al., which is incorporated herein by reference.

The tobacco used in the present invention is typically provided in a shredded, ground, granulated, fine particulate, or powder form. Most preferably, the tobacco is employed in the form of parts or pieces that have an average particle size less than that of the parts or pieces of shredded tobacco used in so-called "fine cut" tobacco products. Typically, the very finely divided tobacco particles or pieces are sized to pass through a screen of about 18 Tyler mesh, generally are sized to pass a screen of about 20 Tyler mesh, often are sized to pass through a screen of about 50 Tyler mesh, frequently are sized to pass through a screen of about 60 Tyler mesh, may even be sized to pass through a screen of 100 Tyler mesh, and further may be sized so as to pass through a screen of 200 Tyler mesh. If desired, air classification equipment may be used to ensure that small sized tobacco particles of the desired sizes, or range of sizes, may be collected. In one embodiment, the tobacco material is in particulate form sized to pass through an 18 Tyler mesh, but not through a 60 Tyler mesh. If desired, differently sized pieces of granulated tobacco may be mixed together. Typically, the very finely divided tobacco particles or pieces suitable for snus products have a particle size greater than −8 Tyler mesh, often −8 to +100 Tyler mesh, frequently −18 to +60 Tyler mesh.

The manner by which the tobacco is provided in a finely divided or powder type of form may vary. Preferably, tobacco parts or pieces are comminuted, ground or pulverized into a powder type of form using equipment and techniques for grinding, milling, or the like. Most preferably, the tobacco is relatively dry in form during grinding or milling, using equipment such as hammer mills, cutter heads, air control mills, or the like. For example, tobacco parts or pieces may be ground or milled when the moisture content thereof is less than about 15 weight percent to less than about 5 weight percent.

Tobacco extracts are useful as components of the tobacco composition. Extracts can be used in solid form (e.g., spray-dried or freeze-dried form), in liquid form, in semi-solid form, or the like. Exemplary tobacco extracts and extraction techniques are set forth, for example, in U.S. Pat. No. 4,150,677 to Osborne, Jr. et al.; U.S. Pat. No. 4,967,771 to Fagg et al.; U.S. Pat. No. 5,005,593 to Fagg et al.; U.S. Pat. No. 5,148,819 to Fagg; and U.S. Pat. No. 5,435,325 to Clapp et al., all of which are incorporated by reference herein. Various tobacco extraction and reconstitution methodologies are set forth in U.S. Pat. No. 5,065,775 to Fagg; U.S. Pat. No. 5,360,022 to Newton; and U.S. Pat. No. 5,131,414 to Fagg, all of which are incorporated by reference herein. See also, the tobacco extract treatment methodologies set forth in U.S. Pat. No. 5,131,415 to Munoz et al. and U.S. Pat. No. 5,318,050 to Gonzalez-Parra, both of which are incorporated by reference herein.

Suitable known reconstituted tobacco processing techniques, such as paper-making techniques or casting-type processes, can be employed in conjunction with the process of the invention. See, for example, the types of paper-making processes set forth in U.S. Pat. No. 3,398,754 to Tughan; U.S. Pat. No. 3,847,164 to Mattina; U.S. Pat. No. 4,131,117 to Kite; U.S. Pat. No. 4,270,552 to Jenkins; U.S. Pat. No. 4,308,877 to Mattina; U.S. Pat. No. 4,341,228 to Keritsis; U.S. Pat. No. 4,421,126 to Gellatly; U.S. Pat. No. 4,706,692 to Gellatly; U.S. Pat. No. 4,962,774 to Thomasson; U.S. Pat. No. 4,941,484 to Clapp; U.S. Pat. No. 4,987,906 to Young; U.S. Pat. No. 5,056,537 to Brown; U.S. Pat. No. 5,143,097 to Sohn; U.S. Pat. No. 5,159,942 to Brinkley et al.; U.S. Pat. No. 5,325,877 to Young; U.S. Pat. No. 5,445,169 to Brinkley; U.S. Pat. No. 5,501,237 to Young; U.S. Pat. No. 5,533,530 to Young; which are incorporated herein by reference. See, for example, the casting processes set forth in U.S. Pat. No. 3,353,541 to Hind; U.S. Pat. No. 3,499,454 to Hind; U.S. Pat. No. 3,483,874 to Hind; U.S. Pat. No. 3,760,815 to Deszyck; U.S. Pat. No. 4,674,519 to Keritsis; U.S. Pat. No. 4,972,854 to Kiernan; U.S. Pat. No. 5,023,354 to Hickle; U.S. Pat. No. 5,099,864 to Young; U.S. Pat. No. 5,101,839 to Jakob; U.S. Pat. No. 5,327,917 to Lekwauwa; U.S. Pat. No. 5,339,838 to Young; U.S. Pat. No. 5,598,868 to Jakob; U.S. Pat. No. 5,715,844 to Young; U.S. Pat. No. 5,724,998 to Gellatly; and U.S. Pat. No. 6,216,706 to Kumar; and EPO 565360; EPO 1055375 and PCT WO 98/01233; which are incorporated herein by reference. Extracts, extracted materials, and slurries used in traditional types of reconstituted tobacco processes can be employed as ingredients in tobacco formulations of the invention.

The process of the invention can be used in connection with any tobacco treatment process where the application of heat is involved, and in conjunction with heat treatment processing aids or additives or in conjunction with ingredients such as casing components. See, for example, the casing materials and methods set forth in U.S. Pat. No. 4,177,822 to Bryant, Jr. et al.; U.S. Pat. No. 4,306,577 to Wu et al.; U.S. Pat. No. 4,449,541 to Mays et al.; U.S. Pat. No. 4,537,204 to Gaisch et al.; U.S. Pat. No. 4,819,668 to Shelar et al.; and U.S. Pat. No. 4,836,224 to Lawson et al., each of which is incorporated by reference herein.

The relative amount of tobacco within the tobacco formulation may vary. Preferably, the amount of tobacco within the tobacco formulation is at least about 10 percent or at least about 25 percent, on a dry weight basis of the formulation. In certain instances, the amounts of other components within the tobacco formulation may exceed about 40 percent, on a dry weight basis. A typical range of tobacco material within the formulation is about 10 to about 60 weight percent, more often about 20 to about 40 weight percent on a dry basis.

The tobacco composition subjected to the heat treatment process of the invention will typically have a certain level of water therein, and can be characterized as a moist tobacco composition. The amount of water can vary from a large excess, where the tobacco composition is in the form of a dispersion, to smaller amounts where the tobacco composition is merely dampened. The water content prior to heat treatment is typically greater than about 10 weight percent, based on the total weight of the composition, more often at least about 20 weight percent. The water content is typically less than about 85 weight percent, more often less than about 75 weight percent. A typical weight range is about 20 to about 50 weight percent. Non-aqueous solvents can also be present in the tobacco composition in addition to water, such as various humectants (e.g., glycerin or propylene glycol).

An additive capable of altering the nature or character of a heat-treated tobacco composition is mixed with the tobacco composition. The additive is, for example, a compound or mixture of compounds that can alter the chemistry or sensory characteristics of the tobacco during the heat treatment process. In one embodiment, the additive is intended to inhibit the reaction between asparagine and reducing sugars present in the tobacco composition, which can lead to compounds such as acrylamide. Tobacco products differ uniquely from food products with regard to certain reactions, such as the reaction between asparagine and reducing sugars. With smoking tobacco products (e.g., cigarettes, cigars, pipe tobacco), the temperature gradient during use is much higher than the temperature encountered in foods during cooking, which can lead to an increased rate of reaction. With certain smokeless tobacco products, the pH can be much higher than the pH of foods and, during processing, heating the tobacco with an increased pH may enhance the rate of certain reactions. Therefore, inhibition of certain reactions can be particularly challenging when dealing with tobacco products.

Exemplary additives include amino acids, compositions incorporating di- and trivalent cations, asparaginase, certain non-reducing saccharides, certain reducing agents, phenolic compounds (e.g., compounds having at least one phenolic functionality), certain compounds having at least one free thiol group or functionality, oxidizing agents, oxidation catalysts, rosemary extract (or other plant extracts derived from herbal or botanical sources), and combinations thereof. Without being bound of a theory of operation, it is believed that these additives are capable of inhibiting reaction of asparagine to form acrylamide, either by providing competing reactions that preferentially react with available reducing sugars, by chemical interaction with asparagine that renders it unable to react with reducing sugars, by chemical interaction with reaction intermediates, or by chemical interaction with acrylamide. Use of certain additives according to the invention is described in U.S. Pat. No. 7,037,540 to Elder et al. and U.S. Pat. No. 7,267,834 to Elder et al.; and US Pat. Appl. Pub. Nos. 2004/0058046 to Zyzak et al; 2005/0196504 to Finley; 2006/0194743 to Oku et al; 2007/0141225 to Elder et al.; 2007/0141227 to Boudreaux et al.; and 2007/0166439 to Soe et al., which are incorporated by reference in their entirety.

The amount of the additive present in the tobacco composition will vary depending on the desired character of the final heat-treated tobacco composition and the type of additive selected. Typically, the amount of additive is at least about 0.01 dry weight percent, more often at least about 0.1 dry weight percent, and most often at least about 1 dry weight percent. The additive is present in an amount typically less than about 15 dry weight percent, such as less than about 10 weight percent or less than about 8 weight percent. In one embodiment, the amount of the additive is about 1 dry weight percent to about 5 dry weight percent. When the additive is asparaginase, the amount of additive can be relatively low, such as less than about 800 ppm or less than about 600 ppm or less than about 500 ppm. Asparaginase may be effective at treatment levels as low as less than about 400 ppm or less than about 300 ppm or even less than about 200 ppm. A typically weight range for asparaginase in the tobacco material is about 100 ppm to about 1,000 ppm. Depending on the type of additive used and the manner in which the additive interacts with the asparagine/reducing sugar reaction, there may be a significant portion of the additive remaining in the composition after heat treatment or very little residual additive could remain.

Although various essential or non-essential amino acids could be used, the amino acid is typically lysine, glycine, histidine, alanine, methionine, glutamic acid, aspartic acid, proline, phenylalanine, valine, arginine, or combinations thereof. Cysteine can also be used.

The di- and trivalent cations are typically used in the form of neutral salts. Less soluble salts, such as those salts comprising carbonate or hydroxide anions can be made more soluble by addition of phosphoric or citric acid. Suggested cations include calcium, magnesium, aluminum, iron, copper, and zinc. Suitable salts of these cations include calcium chloride, calcium citrate, calcium lactate, calcium malate, calcium gluconate, calcium phosphate, calcium acetate, calcium sodium EDTA, calcium glycerophosphate, calcium hydroxide, calcium lactobionate, calcium oxide, calcium propionate, calcium carbonate, calcium stearoyl lactate, magnesium chloride, magnesium citrate, magnesium lactate, magnesium malate, magnesium gluconate, magnesium phosphate, magnesium hydroxide, magnesium carbonate, magnesium sulfate, aluminum chloride hexahydrate, aluminum chloride, aluminum hydroxide, ammonium alum, potassium alum, sodium alum, aluminum sulfate, ferric chloride, ferrous gluconate, ferric ammonium citrate, ferric pyrophosphate, ferrous fumarate, ferrous lactate, ferrous sulfate, cupric chloride, cupric gluconate, cupric sulfate, zinc gluconate, zinc oxide, zinc sulfate, and combinations thereof.

Another exemplary additive is asparaginase, which is an enzyme that decomposes asparagine to aspartic acid and ammonia. The asparaginase is typically used in the form of an aqueous dispersion containing less than 10 weight percent total organic solids (TOS). The number of asparaginase units (ASNU) per gram of the asparaginase composition used in the invention can vary, but is typically in the range of 3000 to 4000. Other enzyme treatments can also be effective, such as a multi-stage enzyme treatment that utilizes a first enzyme to convert certain reducing sugars to a second reducing sugar, and a second enzyme to oxidize the second reducing sugar. For example, fructose can be converted into glucose by the action of the enzyme glucose isomerase, which is also known as xylose isomerase, and glucose can be oxidized by hexose oxidase or glucose oxidase.

Saccharides to replace reducing sugars and/or phenolic substances are believed to suppress the formation of acrylamide from asparagine. Exemplary saccharides include trehalose, reduced palatinose, D-mannitol, D-erythritol, cyclodextrin, and combinations thereof. Commercially available saccharides include "TREHA®", a high purity hydrous crystalline trehalose available from Hayashibara Shoji Inc., Okayama, Japan; "NEOTREHALOSE", a reagent grade crystalline trehalose available from Hayashibara Biochemical Laboratories Inc., Okayama, Japan; "PALATINIT", a powderized reduced palatinose available from Shin Mitsui Sugar Co. Ltd., Tokyo, Japan; and "MANNITOL", a crystalline mannitol powder available from Towa Chemical Industry Co., Ltd., Tokyo, Japan.

Exemplary phenolic substances include catechins (e.g., catechin, epicatechin, and epigalocatechin), flavonoids (e.g., quercetin, isoquercitrin, rutin, naringin, hesperidin), kaempferol, cinnamic acid, quinic acid, 3,4-dihydro-cinnamic acid, 3-coumaric acid, 4-coumaric acid, p-nitorophenol, curcumin, scopoletin, p-hydroxybenzoic acid n-propyl, protoanthocyanidin, and combinations thereof.

Compounds with at least one free thiol (—SH) group can also be used, such as cysteine and cysteine derivatives (e.g., N-acetyl-cysteine), polypeptides with available thiol groups (e.g., glutathione and casein), di-thiothreitol, mercaptoacetic acid, mercaptopropionic acid, mercaptoethanol, and combinations thereof.

Reducing agents capable of reduction of disulfide bonds to thiol groups are believed to be capable of reducing acrylamide levels as long as these reducing agents do not promote the Maillard reaction with asparagine. Exemplary reducing agents include stannous chloride dehydrate, sodium sulfite, sodium meta-bisulfate, ascorbic acid, ascorbic acid derivatives, isoascorbic acid (erythorbic acid), salts of ascorbic acid derivatives, iron, zinc, ferrous ions, ethylenediaminetetraacetic acid (EDTA), citric acid, malic acid, glutaric acid, dicarboxylic acids, and combinations thereof.

Bleaching or oxidizing agents and oxidation catalysts are also believed to be useful to inhibit acrylamide formation from asparagine. Any oxidizing agent capable of transferring oxygen atoms can be used. Exemplary oxidizing agents include peroxides (e.g., hydrogen peroxide), chlorite salts, chlorate salts, perchlorate salts, hypochlorite salts, ozone, ammonia, and combinations thereof. Exemplary oxidation catalysts are titanium dioxide, manganese dioxide, and combinations thereof. Processes for treating tobacco with bleaching agents are discussed, for example, in U.S. Pat. No. 787,611 to Daniels, Jr.; U.S. Pat. No. 1,086,306 to Oelenheinz; U.S. Pat. No. 1,437,095 to Delling; U.S. Pat. No. 1,757,477 to Rosenhoch; U.S. Pat. No. 2,122,421 to Hawkinson; U.S. Pat. No. 2,148,147 to Baier; U.S. Pat. No. 2,170,107 to Baier; U.S. Pat. No. 2,274,649 to Baier; U.S. Pat. No. 2,770,239 to Prats et al.; U.S. Pat. No. 3,612,065 to Rosen; U.S. Pat. No. 3,851,653 to Rosen; U.S. Pat. No. 3,889,689 to Rosen; U.S. Pat. No. 4,143,666 to Rainer; U.S. Pat. No. 4,194,514 to Campbell; U.S. Pat. No. 4,366,824 to Rainer et al.; U.S. Pat. No. 4,388,933 to Rainer et al.; and U.S. Pat. No. 4,641,667 to Schmekel et al.; and PCT WO 96/31255 to Giolvas, all of which are incorporated by reference herein. When utilizing an oxidizing agent, it may be desirable, but it is not necessary, to pretreat the tobacco material with the oxidizing agent and heat the resulting mixture (e.g., heating the treated tobacco material at a temperature of at least about 80° C. for at least about 15 minutes) prior to mixing the treated tobacco material with the remaining components of the mixture.

Depending on the type of tobacco composition being processed, the tobacco composition can include one or more additional components in addition to the tobacco material, water, and the additives described above. Exemplary types of further ingredients, which are discussed in greater detail below, include flavorants, binders, pH adjusters, buffering agents, colorants, disintegration aids, antioxidants, humectants, and preservatives.

The components of the tobacco composition are brought together in admixture using any mixing technique or equipment known in the art. The additives noted above, which may be in liquid or dry solid form, can be admixed with the tobacco in a pretreatment step prior to mixture with any remaining components of the composition or simply mixed with the tobacco together with all other liquid or dry ingredients. Any mixing method that brings the tobacco composition ingredients into intimate contact can be used. A mixing apparatus featuring an impeller or other structure capable of agitation is typically used. Exemplary mixing equipment includes casing drums, conditioning cylinders or drums, liquid spray apparatus, ribbon blenders, mixers available as FKM130, FKM600, FKM1200, FKM2000 and FKM3000 from Littleford Day, Inc., Plough Share types of mixer cylinders, and the like.

The heat treatment of the tobacco composition can be accomplished using any heating method or apparatus known in the art. The heat treatment can be carried out in an enclosed vessel (e.g., one providing for a controlled atmospheric environment, controlled atmospheric components, and a controlled atmospheric pressure), or in a vessel that is essentially open to ambient air. The temperature can be controlled by using a jacketed vessel, direct steam injection into the tobacco, bubbling hot air through the tobacco, and the like. In certain embodiments, the heat treatment step is performed in a vessel also capable of providing mixing of the composition, such as by stirring or agitation. Exemplary mixing vessels include mixers available from Scott Equipment Company, Littleford Day, Inc., Lodige Process Technology, and the Breddo Likwifier Division of American Ingredients Company. Examples of vessels which provide a pressure controlled environment include high pressure autoclaves available from Berghof/America Inc. of Concord, Calif., and high pressure reactors available from The Parr Instrument Co. (e.g., Parr Reactor Model Nos. 4522 and 4552 described in U.S. Pat. No. 4,882,128 to Hukvari et al.). The pressure within the mixing vessel during the process can be atmospheric pressure or elevated pressure (e.g., about 10 psig to about 1,000 psig). In other embodiments, the heat treatment process is conducted in a microwave oven, a convection oven, or by infrared heating.

The temperature and time of the heat treatment process will vary, and generally, the length of the heat treatment will decrease as the temperature of the heat treatment increases. However, the temperature of the heat treatment step can be characterized as elevated, meaning the temperature is greater than room temperature (i.e., greater than 25° C.). The temperature will be determined, in part, by the type of heat treatment process being conducted and the purpose of the heat treatment. Different temperature ranges could be applicable, depending on whether the process is designed for drying, pasteurization, or chemical reaction (e.g., to form flavorful and aromatic compounds). The temperature is generally above about 60° C., often above about 80° C., and more typically above about 100° C., but is generally below about 200° C., often below about 175° C., and most often below about 150° C. Typical temperature ranges include about 60° C. to about 175° C., more often about 80° C. to about 150° C., and most often about 100° C. to about 140° C. In certain embodiments, relatively low temperature heat treatment processes (e.g., below about 100° C. or below about 90° C.) are desired in order to reduce the propensity of asparagine to react to form certain byproducts.

The amount of time that the tobacco composition is subjected to the heat treatment can vary. Normally, the time period is sufficient to heat the mixture at the desired temperature for a period of at least about 10 minutes, typically at least about 20 minutes, more often at least about 30 minutes. Normally, the time period is less than about 3 hours, typically less than about 2 hours, and often less than about 1.5 hours. In certain embodiments, relatively quick heat treatment processes are desired in order to reduce the propensity of asparagine to react to form certain byproducts. In such embodiments, the heating time is no more than about 15 minutes or no more than about 10 minutes.

In certain embodiments, particularly where the heat treatment is applied to a smokeless tobacco composition, the length of the heat treatment is determined by the desired final moisture content of the tobacco composition. Typically, the desired final moisture content of the smokeless tobacco composition is less than about 35 weight percent, based on the total weight of the composition, often less than about 25 weight percent, and most often less than about 20 weight percent. For smokeless tobacco compositions that are formed into desired product shapes (e.g., sheet materials or rod shapes), the final moisture content is typically less than about 15 weight percent or less than about 10 weight percent, and often less than about 8 weight percent.

Atmospheric air, or ambient atmosphere, is the preferred atmosphere for carrying out the heat treatment of the present invention. However, heat treatment can also take place under a controlled atmosphere, such as a generally inert atmosphere. Gases such as nitrogen, argon and carbon dioxide can be used. Alternatively, a hydrocarbon gas (e.g., methane, ethane or butane) or a fluorocarbon gas also can provide at least a portion of a controlled atmosphere in certain embodiments, depending on the choice of treatment conditions and desired reaction products.

The pH of the tobacco composition during heat treatment can also affect the nature and character of the heat-treated product. Aqueous tobacco compositions are normally acidic, but the pH can be adjusted upward by addition of a base, such as sodium hydroxide. It has been determined that the pH of the tobacco composition during heat treatment can affect the reaction between asparagine and reducing sugars. In certain embodiments, the pH of the tobacco composition is less than about 10.0, less than about 9.0, less than about 8.0, less than about 7.5, less than about 7.0, or less than about 6.5. It has been determined that lower pH levels during heat treatment can reduce acrylamide levels in the heat-treated material. In certain embodiments, either no base or reduced amounts of base are added to the tobacco composition to achieve the pH levels noted above. A representative technique for determining the pH of a tobacco formulation involves dispersing 5 g of that formulation in 100 ml of high performance liquid chromatography water, and measuring the pH of the resulting suspension/solution (e.g., with a pH meter).

Although lowering the heat treatment temperature or treatment time can reduce certain reactions as noted above, there are instances where reduced time or temperature may be undesirable. For example, where the heat treatment process is intended to produce flavorable and aromatic Maillard reaction products, reducing temperature or time of the heat treatment process will also result in reduced production of desired compounds. Consequently, in certain embodiments, it may be advantageous to use one of the additives set forth herein to inhibit reactions as opposed to altering heat treatment conditions.

The heat treatment process of the invention can be combined with additional processes designed to disrupt cellular membranes and, consequently, allow better penetration of the additives noted above into the tobacco material. For example, the tobacco material of the tobacco composition can be subjected to ultrasonic energy, application of a vacuum, or treated with cell weakening enzymes prior to or during the heat treatment process of the invention.

In one aspect of the invention, the heat treatment process is used to treat a smokeless tobacco composition. For example, the heat treatment process can be used to dry a smokeless tobacco composition that has been formed into a desired product shape. Such smokeless tobacco compositions, in addition to tobacco, water, and the additives noted above, also typically include additional components such as flavorants, fillers, binders, pH adjusters, buffering agents, colorants, disintegration aids, antioxidants, humectants, and preservatives.

Exemplary flavorants that can be used are components, or suitable combinations of those components, that act to alter the bitterness, sweetness, sourness, or saltiness of the smokeless tobacco product, enhance the perceived dryness or moistness of the formulation, or the degree of tobacco taste exhibited by the formulation. Types of flavorants include salts (e.g., sodium chloride, potassium chloride, sodium citrate, potassium citrate, sodium acetate, potassium acetate, and the like), natural sweeteners (e.g., fructose, sucrose, glucose, maltose, mannose, galactose, lactose, and the like), artificial sweeteners (e.g., sucralose, saccharin, aspartame, acesulfame K, neotame, and the like); and mixtures thereof. The amount of flavorants utilized in the tobacco composition can vary, but is typically up to about 10 dry weight percent, and certain embodiments are characterized by a flavorant content of at least about 1 dry weight percent, such as about 1 to about 10 dry weight percent. Combinations of flavorants are often used, such as about 0.1 to about 2 dry weight percent of an artificial sweetener and about 0.5 to about 8 dry weight percent of a salt such as sodium chloride.

Exemplary filler materials include vegetable fiber materials such as sugar beet fiber materials (e.g., FIBREX® brand filler available from International Fiber Corporation), oats or other cereal grain (including processed or puffed grains), bran fibers, starch, or other modified or natural cellulosic materials such as microcrystalline cellulose. Additional specific examples include corn starch, maltodextrin, dextrose, calcium carbonate, calcium phosphate, lactose, mannitol, xylitol, and sorbitol. The amount of filler utilized in the tobacco composition can vary, but is typically up to about 50 dry weight percent, and certain embodiments are characterized by a filler content of at least about 10 dry weight percent, such as about 20 to about 50 dry weight percent. Combinations of fillers are often used, such as about 2 to about 8 dry weight percent of calcium carbonate, about 10 to about 20 dry weight percent of rice flour, and about 10 to about 20 weight percent of maltodextrin.

Typical binders include povidone, sodium carboxymethylcellulose and other modified cellulosic materials, sodium alginate, xanthan gum, starch-based binders, gum arabic, pectin, carrageenan, pullulan, zein, and the like. The amount of binder utilized in the tobacco composition can vary, but is typically up to about 30 dry weight percent, and certain embodiments are characterized by a binder content of at least about 5 dry weight percent, such as about 5 to about 30 dry weight percent.

Preferred pH adjusters or buffering agents provide and/or buffer within a pH range of about 6 to about 10, and exemplary agents include metal hydroxides, metal carbonates, metal bicarbonates, and mixtures thereof. Specific exemplary materials include sodium hydroxide, potassium hydroxide, potassium carbonate, sodium carbonate, and sodium bicarbonate. The amount of pH adjuster or buffering material utilized in the tobacco composition can vary, but is typically up to about 5 dry weight percent, and certain embodiments can be characterized by a pH adjuster/buffer content of at least about 0.5 dry weight percent, such as about 1 to about 5 dry weight percent.

Exemplary colorants include various dyes and pigments, such as caramel coloring and titanium dioxide. The amount of colorant utilized in the tobacco composition can vary, but is typically up to about 3 dry weight percent, and certain embodiments are characterized by a colorant content of at least about 0.1 dry weight percent, such as about 0.5 to about 3 dry weight percent.

Exemplary humectants include glycerin and propylene glycol. The amount of humectant utilized in the tobacco composition can vary, but is typically up to about 2 dry weight percent, and certain embodiments can be characterized by a humectant content of at least about 0.1 dry weight percent, such as about 0.2 to about 2 dry weight percent.

Other ingredients such as preservatives (e.g., potassium sorbate) or disintegration aids (e.g., microcrystalline cellulose, croscarmellose sodium, crospovidone, sodium starch glycolate, pregelatinized corn starch, and the like) can also be used. Typically, such ingredients are used in amounts of up to about 10 dry weight percent and usually at least about 0.1 dry weight percent, such as about 0.5 to about 10 dry weight percent.

Particularly with respect to smokeless tobacco compositions, the tobacco compositions of the invention can be formed into desired product shapes either before or after the heat treatment step. Typically, the forming step occurs prior to heat treatment because the higher water content present prior to heating increases the malleability of the composition. The method and apparatus used to form the tobacco composition will depend on the desired shape. Exemplary shapes include pill, tablet, sphere, sheet, coin, cube, bead, ovoid, obloid, bean, stick, and rod. For example, the tobacco composition can have the form of compressed tobacco pellets, multi-layered extruded pieces, extruded or formed rods or sticks, compositions having one type of tobacco formulation surrounded by a different type of tobacco formulation, rolls of tape-like films, readily water-dissolvable or water-dispersible films or strips (see, for example, US Pat. Appl. Pub. No. 2006/0198873 to Chan et al.), or capsule-like materials possessing an outer shell (e.g., a pliable or hard outer shell that can be clear, colorless, translucent or highly colored in nature) and an inner region possessing tobacco or tobacco flavor (e.g., a Newtoniam fluid or a thixotropic fluid incorporating tobacco of some form).

Processed tobacco compositions, such as compressed tobacco pellets, can be produced by compacting granulated tobacco and associated formulation components in the form of a pellet, and optionally coating each pellet with an overcoat material. Exemplary granulation devices are available as the FL-M Series granulator equipment (e.g., FL-M-3) from Vector Corporation and as WP 120V and WP 200VN from Alexanderwerk, Inc. Exemplary compaction devices, such as compaction presses, are available as Colton 2216 and Colton 2247 from Vector Corporation and as 1200i, 2200i, 3200, 2090, 3090 and 4090 from Fette Compacting. Devices for providing outer coating layers to compacted pelletized tobacco formulations are available as CompuLab 24, CompuLab 36, Accela-Cota 48 and Accela-Cota 60 from Thomas Engineering.

Processed tobacco compositions, such as multi-layered tobacco pellets, can be manufactured using a wide variety of extrusion techniques. For example, multi-layered tobacco pellets can be manufactured using co-extrusion techniques (e.g., using a twin screw extruder). In such a situation, successive wet or dry components or component mixtures can be placed within separate extrusion hoppers. Steam, gases (e.g., ammonia, air, carbon dioxide, and the like), and humectants (e.g., glycerin or propylene glycol) can be injected into the extruder barrel as each dry mix is propelled, plasticized, and cooked. As such, the various components are processed so as to be very well mixed, and hence, come in complete contact with each other. For example, the contact of components is such that individual components can be well embedded in the extrusion matrix or extrudate. See, for example, U.S. Pat. No. 4,821,749 to Toft et al., which is incorporated herein by reference. Multilayered materials can have the general form of films, and alternatively, multi-layered generally spherical materials can possess various layers extending from the inside outward.

Some shapes, such as rods or cubes, can be formed by first extruding the material through a die having the desired cross-section (e.g., round or square) and then optionally cutting the extruded material into desired lengths. Exemplary extrusion equipment suitable for use in the invention include industrial pasta extruders such as Model TP 200/300 available from Emiliomiti, LLC of Italy. Sheet-like materials can be prepared by applying the tobacco composition onto a moving belt and passing the moving belt through a nip formed by opposing rollers, followed by cutting the sheet into desired lengths.

The present invention provides a heat-treated tobacco composition, such as a heat-treated smokeless tobacco composition, having an acrylamide content of less than about 2000 ppb (or ng/g). Typically, the acrylamide content is less than about 1500 ppb, often less than about 1000 ppb, and most often less than about 900 ppb. Compositions having an acrylamide content of less than about 800 ppb, less than about 700 ppb, less than about 600 ppb, less than about 500 ppb, less than about 400 ppb, or less than about 300 ppb can be produced.

The heat-treated tobacco compositions of the invention are useful as additives for the manufacture of smoking articles. For example, the composition prepared in accordance with the present invention can be mixed with casing materials and applied to tobacco as a casing ingredient, incorporated into smoking articles as a top dressing ingredient, or incorporated into reconstituted tobacco materials. Tobacco cut filler can be the tobacco material treated according to the invention and then incorporated into a smoking article as part of the smokable material charge. Still further, the heat-treated compositions of the invention can be incorporated into a cigarette filter (e.g., in the filter plug, plug wrap, or tipping paper) or incorporated into cigarette wrapping paper, preferably on the inside surface, during the cigarette manufacturing process. The heat-treated compositions can also be used as an additive within certain aerosol-generating electronic smoking articles, such as those described in US Pat. Appl. Pub. No. 2008/0092912 to Robinson et al., which is incorporated by reference herein in its entirety.

The heat-treated composition could be incorporated into the tobacco blends, representative cigarette components, and representative cigarettes manufactured therefrom, set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,220,930 to Gentry; and U.S. Pat. No. 5,360,023 to Blakley et al.; US Pat. Application 2002/0000235 to Shafer et al.; and PCT WO 02/37990. Those tobacco materials also can be employed for the manufacture of those types of cigarettes that are described in U.S. Pat. No. 4,793,365 to Sensabaugh; U.S. Pat. No. 4,917,128 to Clearman et al.; U.S. Pat. No. 4,947,974 to Brooks et al.; U.S. Pat. No. 4,961,438 to Korte; U.S. Pat. No. 4,920,990 to Lawrence et al.; U.S. Pat. No. 5,033,483 to Clearman et al.; U.S. Pat. No. 5,074,321 to Gentry et al.; U.S. Pat. No. 5,105,835 to Drewett et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,247,949 to Deevi et al.; U.S. Pat. No. 5,551,451 to Riggs et al.; U.S. Pat. No. 5,285,798 to Banerjee et al.; U.S. Pat. No. 5,593,792 to Farrier et al.; U.S. Pat. No. 5,595,577 to Bensalem et al.; U.S. Pat. No. 5,816,263 to Counts et al.; U.S. Pat. No. 5,819,751 to Barnes et al.; U.S. Pat. No. 6,095,153 to Beven et al.; U.S. Pat. No. 6,311,694 to Nichols et al.; and U.S. Pat. No. 6,367,481 to Nichols, et al.; and PCT WO 97/48294 and PCT WO 98/16125. See, also, those types of commercially marketed cigarettes described *Chemical and Biological Studies on New Cigarette Prototypes that Heat Instead of Burn Tobacco*, R. J. Reynolds Tobacco Company Monograph (1988) and *Inhalation Toxicology,* 12:5, p. 1-58 (2000).

In certain embodiments where the heat-treated tobacco composition is used as a smokable material, the resulting smoking article can be characterized by a reduced acrylamide level in mainstream smoke during use. For example, the smoking article can be characterized by a reduction in acrylamide level in mainstream smoke relative to an untreated control smoking article (i.e., a comparable smoking article except containing no tobacco treated according to the invention) of at least about 10 percent, at least about 20 percent, at least about 30 percent, at least about 40 percent, at least about 50 percent, at least about 60 percent, at least about 70 percent, at least about 80 percent, or more. In other words, the smoking article of the invention, such as a cigarette, containing the treated tobacco composition of the invention can produce a reduced amount of acrylamide by weight in mainstream smoke as compared to an untreated control smoking article smoked using the same smoking machine and under the same smoking conditions, such as the smoking machines and smoking conditions set forth in ISO 3308:1991 and ISO 4387:1991, which are incorporated by reference herein.

The composition resulting from the method of the invention can also be used as a smokeless tobacco product or incorporated as an additive in a smokeless tobacco product. Various types of smokeless tobacco products are set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, III et al.; and U.S. Pat. No. 5,387,416 to White et al.; US Pat. App. Pub. Nos. 2005/0244521 to Strickland et al. and 2008/0196730 to Engstrom et al.; PCT WO 04/095959 to Arnarp et al.; PCT WO 05/063060 to Atchley et al.; PCT WO 05/016036 to Bjorkholm; and PCT WO 05/041699 to Quinter et al., each of which is incorporated herein by reference. See also, the types of smokeless tobacco formulations, ingredients, and processing methodologies set forth in U.S. Pat. No. 6,953,040 to Atchley et al. and U.S. Pat. No. 7,032,601 to Atchley et al.; US Pat. Appl. Pub. Nos. 2002/0162562 to Williams; 2002/0162563 to Willams; 2003/0070687 to Atchley et al.; 2004/0020503 to Williams, 2005/0178398 to Breslin et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; and 2008/0209586 to Neilsen et al., each of which is incorporated herein by reference.

EXPERIMENTAL

The present invention is more fully illustrated by the following examples, which are set forth to illustrate the present invention and are not to be construed as limiting thereof. In the following examples, g means gram, ng means microgram, mg means milligram, ng means nanogram, L means liter, mL means milliliter, μL means microliter, and ppm means parts per million. All weight percentages are expressed on a dry basis, meaning excluding water content, unless otherwise indicated.

The method for analysis of the acrylamide used a Thermo Surveyor MS Liquid Chromatograph (LC) equipped with a Phenomonex Gemini-NX 5 μm, 2.1×150 mm $C_{18}$ HPLC column using isocratic elution. Mobile phase A (92%) is 0.1% v/v formic acid in water and mobile phase B (8%) is 100% methanol (MeOH). The column temperature is 30° C. and the autosampler tray is set to 4° C. One microliter of the extract is injected onto the column. The flow rate is 175 with 10 minutes equilibration time. The detection of acrylamide is achieved using a Thermo TSQ Quantum Ultra triple-quadrupole mass spectrometer. The LC effluent flows directly into the electrospray interface of the mass spectrometer. The interface is operated in the positive ion mode with a spray voltage of 3.5 kV. The ion transfer tube (heated capillary) is set to 250° C. Selected reaction monitoring is used focusing on transitions of m/z 72→55 with collision energy of 12 V and m/z 72→44 with collision energy of 32 V, as determined by direct infusion of acrylamide. One gram of sample is dissolved in 90:10 (v/v) water:methanol for 1 hour using an orbital shaker set to 300 rpm. The extract is then filtered through a 0.45 μm PTFE filter; the filtrate is subsequently analyzed by the LC-MS/MS system described above.

The tobacco used in Examples 1-5 is a blend of 75% by weight flue cured tobacco and 25% sun cured tobacco. The acrylamide content of the tobacco blend, rice flour and maltodextrin is less than the quantitation limit of 75 ng/g. The xanthan gum contains about 120 ng/g acrylamide. For all examples, the dry ingredients are added to a Popeil Automatic Pasta Maker (Model P400 Food Preparer, Ronco Inventions LLC, Chatsworth, Calif.). The wet blend is made by dissolving sodium hydroxide in water, then adding the glycerin.

This wet blend solution is slowly added to the dry ingredients while in "mix" mode following the instructions for use on mixing. The Pasta Maker is then switched to "extrude" mode and approximately 1 foot long rods are extruded through the Oriental Noodle die (hole size about 3.15 mm). All holes but four on the bottom of the die are blocked with a circular piece of plastic, which is cut away to reveal the bottom holes. This piece of plastic is placed inside the die on the side facing the machine.

The rods are placed on 22½ inch diameter corrugated metal screens made to fit rotating trays inside the oven. The corrugations keep the rods straight while drying. The oven is a Hotpack Digamatec convection oven (Hotpack Corporation, Philadelphia, Pa.) with 10 rotating trays. The drying temperature is 280° F. (138° C.).

Examples 6-9 describe testing to determine the effect of using certain additive-treated tobacco materials on acrylamide content of mainstream smoke generated by cigarettes containing the treated tobacco. The manner of treating the tobacco with the additive in these examples involves placing about 15 g of CAMEL Blue tobacco blend or 25 g of a Turkish blend in a pre-weighed plastic bag. The bag is clamped inside a pan coater to rotate the sample inside the bag. A pre-weighed water solution containing the additive is sprayed onto the rotating tobacco sample using an atomizer in an attempt to get as uniform an application as possible. The solution weight is targeted to give about 40% additional moisture to the tobacco blends. The bag is then removed from the pan coater, sealed and reweighed to determine the exact amount of solution added. The bag is shaken several times to mix and allow any solution on the sides of the bag to be absorbed into the tobacco. The samples are allowed to incubate for 2 hours 25 minutes to 3 hours 25 minutes at room temperature. The tobacco is then put on stainless steel plates and heated for 10 minutes in an oven. The oven temperature is 73° C. at the start and 85° C. at the end of the heating time. After removing from the oven, the tobacco is covered with paper towels and allowed to dry overnight at ambient conditions (24° C., 36% RH). After drying overnight, the tobacco feels very dry and crunchy. The tobacco samples are put in a conditioning cabinet at 24° C., 60% RH for 5 days and then stored in sealed plastic bags in the conditioning cabinet until cigarettes are hand made using the tobacco. Tobacco moisture is measured on 1 gram samples using a Mettler moisture meter at 105° C. with a cutoff of 1 mg weight loss in 50 seconds. The Turkish blend initial moisture is 11.4% and the final conditioned moisture is 11.6%. The CAMEL Blue initial moisture is 10.2% and the final conditioned moisture is 13.8%.

For the analysis of smoke acrylamide, handmade cigarettes are made from the treated tobaccos in Examples 6-9. The smoke from these cigarettes is collected using a Cerulean SM 450 smoking machine (Cerulean, Linford Wood East, UK). The machine air flows are tuned for ISO conditions (ISO 3308:1991 and ISO 4387:1991). The smoking is performed under one regimen using 35 mL puff volume, 2 s puff, and 60 s puff interval (indicated as ISO). The cigarettes do not have the ventilation blocked. The collected smoke is analyzed for acrylamide content as described above.

Example 1

Control Formulation and Effect of Drying Time

Rods made using the formula set forth in Table 1 below are dried for 10, 15, 20, and 40 minutes to demonstrate the effect of drying time on acrylamide formation. The sample dried for 15 minutes was used as a control for comparison for all experiments.

TABLE 1

| | % w/w | g/batch |
|---|---|---|
| Dry ingredients: | | |
| Tobacco | 40.0% | 120.0 |
| Sucralose (Tate and Lyle Sucralose Inc., Decatur, IL) | 1.0% | 3.0 |
| Titanium dioxide (Mutchler Inc., Harrington Park, NJ) | 1.0% | 3.0 |
| Calcium Carbonate HD PPT Fine (Univar USA Inc., Seattle, WA) | 5.0% | 15.0 |
| Maltodextrin 10DE (Grain Processing Corp. Muscatine, IA) | 16.0% | 48.0 |
| Rice Flour (Remy n.v., Leuven-Wijgmaal, Belgium) | 16.0% | 48.0 |
| Xanthan gum (Tic Gums Inc., Belcamp, MD) | 15.0% | 45.0 |
| Sodium chloride USP (J. T. Baker, Mallinckrodt Baker Inc., Phillipsburg, NJ) | 4.0% | 12.0 |
| Wet blend: | | |
| Sodium hydroxide (Certified A.C.S., Fisher Scientific, Fair Lawn, NJ) | 1.5% | 4.5 |
| Glycerin (Vitusa Products Inc., Berkeley Height, NJ) | 0.5% | 1.5 |
| 110 mL of Water | | |
| Total ingredients except water: | 100% | 300.0 |

The control sample dried for fifteen minutes has an acrylamide content of 2559 ng/g. Reducing the drying time to 10 minutes results in a 44% reduction in acrylamide content as compared to the control, while increasing the drying time to 20 minutes increases acrylamide content by 39% as compared to the control. Further increases in drying time result in smaller increases (or even decreases) in acrylamide content as compared to the control, with a 30 minute drying time leading to a 24% increase and a 40 minute drying time leading to a reduction in acrylamide content of 4%, as compared to the control. Thus, increasing the drying time can lead to increases in acrylamide content until a maximum content is achieved, after which further increases in drying time do not raise acrylamide content and may lead to slight reductions.

Example 2

Effect of pH

A tobacco composition is processed the same as the control sample in Example 1, except that the sodium hydroxide is reduced to 2.25 g (one-half of the amount used in Example 1). Maltodextrin is increased to 49.10 g and rice flour is increased to 49.15 g. The pH before drying is 7.54 and the pH after drying is 7.27. The acrylamide content is 1250 ng/g, which represents a 51% decrease in acrylamide as compared to the control sample, which has a pH of 8.68 before drying and 8.08 after drying.

Another tobacco composition is processed the same as Example 1, except that no sodium hydroxide is added. Maltodextrin and rice flour are increased to 50.25 g each. The pH before drying is 6.51 and the pH after drying is 6.56. The acrylamide content is 178 ng/g, a drop of 93% as compared to the control. This testing indicates that acrylamide content increases with increases in pH during drying.

Example 3

Effect of Amino Acids

L-lysine HCl is dissolved in 80 mL of water and the solution is stirred into the tobacco. The solution is allowed to soak into the tobacco for 20 minutes before using. The treated tobacco is mixed with the other dry ingredients in the Pasta Maker. The final composition has the formulation set forth in Table 2 below. The formulation is otherwise processed in the same manner as the control sample in Example 1.

TABLE 2

| | % w/w | g/batch |
|---|---|---|
| Dry ingredients: | | |
| Tobacco | 40.0% | 120.0 |
| L-Lysine HCl monohydrate, USP (J. T. Baker, Mallinckrodt Baker Inc., Phillipsburg, NJ) | 1.0% | 3.00 |
| 80 mL of water | | |
| Sucralose | 1.0% | 3.00 |
| Titanium dioxide | 1.0% | 3.00 |
| Calcium Carbonate (HD PPT Fine) | 5.0% | 15.00 |
| Maltodextrin (10DE) | 15.3% | 46.00 |
| Rice Flour | 15.2% | 45.50 |
| Xanthan gum | 15.3% | 45.75 |
| Sodium chloride | 4.0% | 12.00 |
| Wet blend: | | |
| Sodium hydroxide | 1.8% | 5.25 |
| Glycerin | 0.5% | 1.50 |
| 30 mL of water | | |
| Total ingredients except water: | 100% | 300.00 |

Another formulation is prepared in the same matter as the formulation of Table 2, except that the L-lysine HCl is increased to 7.5 g (2.5% by dry weight). Maltodextrin, rice flour, and xanthan gum are reduced to 44.25 g each.

Another formulation is prepared in the same matter as the formulation of Table 2, except that 7.5 g of L-cysteine (97%, Sigma-Aldrich, St. Louis, Mo.) (2.5% by dry weight) is substituted for L-lysine HCl. Maltodextrin is reduced to 45.5 g, xanthan gum is reduced to 42.5 g, and sodium hydroxide is reduced to 4.50 g.

The addition of L-lysine prior to drying reduces the acrylamide content by 63% (1.0% by dry weight L-lysine HCl) and 73% (2.5% by dry weight L-lysine HCl), respectively, as compared to the control. The addition of L-cysteine prior to drying reduces the acrylamide content by 74% as compared to the control.

Example 4

Effect of Asparaginase

Acrylaway L (Novozymes North America Inc., Franklinton, N.C.), a commercial enzyme preparation containing 3500 asparaginase units (ASNU) per gram, is used. The enzyme preparation contains approximately 4% total organic solids (TOS), 46% water, 50% glycerol, 0.3% sodium benzoate, and 0.1% potassium sorbate (Novozymes A/S; An Asparaginase Enzyme Preparation Produced a Strain of *Aspergillus oryzae* Expressing the *Aspergillus oryzae* Asparaginase Gene; Nov. 9, 2006; a dossier submitted to JECFA).

The Acrylaway L is diluted with 80 mL water and the solution is added to the tobacco while stirring. After 60 minutes, the treated tobacco is added to the other dry ingredients in the Pasta Maker. Glycerin in the wet blend is reduced because the Acrylaway L also contains glycerin. A formulation with 250 ppm TOS asparaginase is set forth in Table 3 below. The formulation is otherwise processed in the same manner as the control sample in Example 1.

TABLE 3

| | % w/w | g/batch |
|---|---|---|
| Dry ingredients: | | |
| Tobacco | 40.0% | 120.0 |
| Acrylaway (includes 0.37 g glycerin and 0.345 g water) | 0.1% | 0.75 |
| 80 mL of water | | |
| Sucralose | 1.0% | 3.00 |
| Titanium dioxide | 1.0% | 3.00 |
| Calcium Carbonate (HD PPT Fine) | 5.0% | 15.00 |
| Maltodextrin (10DE) | 16.0% | 48.00 |
| Rice Flour | 16.0% | 48.00 |
| Xanthan gum | 15.0% | 45.00 |
| Sodium chloride | 4.0% | 12.00 |
| Wet blend: | | |
| Sodium hydroxide | 1.5% | 4.50 |
| Glycerin | 0.4% | 1.14 |
| 30 mL of water | | |
| Total ingredients except water: | 100% | 300.05 |

A second formulation including 500 ppm TOS asparaginase is also prepared with the formulation being the same as that shown in Table 3, except Acrylaway L is increased to 1.50 g and glycerin in the wet blend is decreased to 0.78 g.

Drying of the formulation containing 250 ppm TOS asparaginase results in a reduction in acrylamide content of 67% as compared to the control. The 500 ppm TOS asparaginase formulation has an acrylamide content that is 69% lower than the control upon drying.

The presence of the asparaginase converts asparagine to aspartic acid. The asparagine and aspartic acid content of the control sample after drying is 0.073% and 0.041%, respectively. The level of asparagine in the final product for the two asparaginase-containing samples are below the quantitation limit of the analysis (0.043%). The aspartic acid content for the two asparaginase-containing samples increases to 0.13%.

Example 5

Effect of Oxidizing Agent

The tobacco is mixed with 80 mL of 3% hydrogen peroxide. After mixing, the tobacco is placed into an oven at 200° F. (93° C.) for 30 minutes. The tobacco is then added to the other dry ingredients in the Pasta Maker. The formulation of this sample is set forth in Table 4 below.

TABLE 4

| | % w/w | g/batch |
|---|---|---|
| Dry ingredients: | | |
| Tobacco | 40.0% | 120.0 |
| 80 mL of 3% hydrogen peroxide (CVS Pharmacy, Woonsocket, RI) | | |
| Sucralose | 1.0% | 3.00 |
| Titanium dioxide | 1.0% | 3.00 |
| Calcium Carbonate (HD PPT Fine) | 5.0% | 15.00 |
| Maltodextrin (10DE) | 16.0% | 48.00 |
| Rice Flour | 16.0% | 48.00 |
| Xanthan gum | 15.0% | 45.00 |
| Sodium chloride | 4.0% | 12.00 |
| Wet blend: | | |
| Sodium hydroxide | 1.5% | 4.50 |
| Glycerin | 0.5% | 1.50 |
| 50 mL of Water | | |
| Total ingredients except water: | 100% | 300.00 |

This formulation is otherwise processed the same as the control sample in Example 1, except the drying time is 10 minutes. The final acrylamide content is 68% less than the control sample.

Example 6

A 2007 crop year Turkish Samsun (Turkish SA), which has a relatively high level of asparagine, is treated with Acrylaway L asparaginase as the treatment additive (about 507 ppm TOS added), and cigarettes are hand made using the treated tobacco and smoked under ISO conditions in the manner described above. The smoke is collected and tested for acrylamide content as described herein. The cigarette containing asparaginase-treated tobacco produces less acrylamide in mainstream smoke as compared to a control cigarette containing water-treated tobacco. The reduction is about 72.9% as compared to the control cigarette.

Example 7

A CAMEL Blue tobacco blend is removed from a CAMEL Blue cigarette and treated with Acrylaway L asparaginase as the treatment additive (about 558 ppm TOS added), and cigarettes are hand made using the treated tobacco and smoked under ISO conditions in the manner described above. The smoke is collected and tested for acrylamide content as described herein. The cigarette containing asparaginase-treated tobacco produces less acrylamide in mainstream smoke as compared to a control cigarette containing water-treated tobacco. The reduction is about 62.5% as compared to the control cigarette.

Example 8

A CAMEL Blue tobacco blend is removed from a CAMEL Blue cigarette and treated with L-lysine HCl (Ajinomoto Aminoscience LLC, Raleigh, N.C.), as the treatment additive (about 0.377 g of L-lysine added), and cigarettes are hand made using the treated tobacco and smoked under ISO conditions in the manner described above. The smoke is collected and tested for acrylamide content as described herein. The cigarette containing lysine-treated tobacco produces less acrylamide in mainstream smoke as compared to a control cigarette containing water-treated tobacco. The reduction is about 9.5% as compared to the control cigarette.

Example 9

A CAMEL Blue tobacco blend is removed from a CAMEL Blue cigarette and treated with 3% hydrogen peroxide ($H_2O_2$) solution as the treatment additive (about 9.7 g of hydrogen peroxide added), and cigarettes are hand made using the treated tobacco and smoked under ISO conditions in the manner described above. The smoke is collected and tested for acrylamide content as described herein. The treatment does not result in a reduction in acrylamide in mainstream smoke as compared to a control cigarette containing water-treated tobacco.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A method of preparing a tobacco material for use in a smoking article, comprising:

(i) mixing a tobacco material, water, a buffering agent that buffers within a pH range of about 6 to about 10 and an additive capable of inhibiting reaction of asparagine to form acrylamide upon heating or burning of the tobacco material, thereby forming a moist tobacco mixture, wherein the additive is asparaginase;

(ii) heating the moist tobacco mixture to form a heat-treated tobacco mixture, wherein the pH of the moist tobacco mixture during the heating step is less than about 10; and (iii) incorporating the heat-treated tobacco mixture into a smoking article as a smokable material, wherein the smoking article is in the form of a cigarette comprising a rod of smokable material circumscribed by a wrapping material and a filter attached to the rod at one end thereof, wherein the smokable material comprises the heat-treated tobacco mixture.

2. The method of claim 1, wherein the tobacco material is in the form of cut filler.

3. The method of claim 1, wherein the tobacco material is in the form of a tobacco blend.

4. The method of claim 1, wherein the additive is present in an amount of between about 100 ppm to about 10 weight percent, based on the dry weight of the tobacco mixture.

5. The method of claim 1, wherein the smoking article is a cigarette.

6. The method of claim 1, wherein the smoking article, upon smoking, is characterized by an acrylamide content of mainstream smoke that is reduced relative to an untreated control smoking article.

7. The method of claim 6, wherein the amount of acrylamide reduction by weight in mainstream smoke is at least about 10 percent as compared to an untreated control smoking article.

8. The method of claim 7, wherein the amount of acrylamide reduction in mainstream smoke is at least about 30 percent as compared to an untreated control smoking article.

9. The method of claim 8, wherein the amount of acrylamide reduction in mainstream smoke is at least about 50 percent as compared to an untreated control smoking article.

10. The method of claim 9, wherein the amount of acrylamide reduction in mainstream smoke is at least about 60 percent as compared to an untreated control smoking article.

11. The method of claim 1, wherein the heat-treated tobacco mixture comprises less than about 2000 ppb of acrylamide.

12. The method of claim 11, wherein the heat-treated tobacco mixture comprises less than about 1500 ppb of acrylamide.

13. The method of claim 12, wherein the heat-treated tobacco mixture comprises less than about 1000 ppb of acrylamide.

14. A smoking article in the form of a cigarette prepared according to the method of claim 1.

15. A smoking article in the form of a cigarette comprising a rod of smokable material circumscribed by a wrapping material and a filter attached to the rod at one end thereof, wherein the smokable material comprises a tobacco material pre-treated to inhibit reaction of asparagine to form acrylamide in mainstream smoke, wherein the pre-treatment comprises heating the tobacco material at a pH of less than about 10 in the presence of an additive, wherein the additive is asparaginase, and wherein the tobacco material comprises a buffering agent that buffers within a pH range of about 6 to about 10.

16. The smoking article of claim 15, wherein the smoking article, upon smoking, is characterized by an acrylamide content of mainstream smoke that is reduced relative to an untreated control smoking article.

17. The smoking article of claim 16, wherein the amount of acrylamide reduction by weight in mainstream smoke is at least about 10 percent as compared to an untreated control smoking article.

18. The smoking article of claim 17, wherein the amount of acrylamide reduction in mainstream smoke is at least about 30 percent as compared to an untreated control smoking article.

19. The smoking article of claim 18, wherein the amount of acrylamide reduction in mainstream smoke is at least about 50 percent as compared to an untreated control smoking article.

20. The smoking article of claim 19, wherein the amount of acrylamide reduction in mainstream smoke is at least about 60 percent as compared to an untreated control smoking article.

21. The smoking article of claim 15, wherein the buffering agent is selected from the group consisting of metal carbonates, metal bicarbonates, and mixtures thereof.

22. The smoking article of claim 15, wherein the buffering agent comprises sodium carbonate and sodium bicarbonate.

* * * * *